US009457483B2

(12) United States Patent
Wu et al.

(10) Patent No.: US 9,457,483 B2
(45) Date of Patent: Oct. 4, 2016

(54) CUTTER ASSEMBLY HAVING DUAL LOCKING EFFECT

(71) Applicant: SDI CORPORATION, Chang Hua (TW)

(72) Inventors: Chien-Lung Wu, Chang Hua (TW); Chih-Wei Hsu, Chang Hua (TW); Yao-Chia Chu, Chang Hua (TW); Cheng-Yu Pai, Chang Hua (TW); Chi-Cheng Hung, Chang Hua (TW)

(73) Assignee: SDI CORPORATION, Changhua (TW)

( * ) Notice: Subject to any disclaimer, the term of this patent is extended or adjusted under 35 U.S.C. 154(b) by 153 days.

(21) Appl. No.: 14/163,941

(22) Filed: Jan. 24, 2014

(65) Prior Publication Data

US 2015/0209968 A1 Jul. 30, 2015

(51) Int. Cl.

| | |
|---|---|
| ***B26B 3/06*** | (2006.01) |
| ***B25F 3/00*** | (2006.01) |
| ***B26B 1/00*** | (2006.01) |
| ***F41B 13/02*** | (2006.01) |
| ***B26B 1/08*** | (2006.01) |
| ***B26B 5/00*** | (2006.01) |

(52) U.S. Cl.
CPC *B26B 1/08* (2013.01); *B26B 5/002* (2013.01)

(58) Field of Classification Search
CPC ..... B26B 1/08; B26B 5/002
USPC ..... 30/161, 125, 335, 2, 337, 339, 162, 124
See application file for complete search history.

(56) References Cited

U.S. PATENT DOCUMENTS 4,240,202 A * 12/1980 Gilbert ..... B26B 5/002 30/162
5,269,063 A * 12/1993 Okada ..... B26B 5/002 30/162
5,497,553 A * 3/1996 Chong ..... B26B 5/002 30/162
5,502,896 A * 4/1996 Chen ..... B26B 5/002 30/162
5,966,817 A * 10/1999 Lee ..... B26B 5/001 30/162
6,745,474 B1 * 6/2004 Huang ..... B26B 5/002 30/162
7,434,317 B2 * 10/2008 Levine ..... B26B 5/002 30/162
7,987,602 B2 * 8/2011 Kanemoto ..... B26B 5/001 30/152
8,069,571 B2 * 12/2011 Chung ..... B26B 5/00 30/162
8,413,339 B2 * 4/2013 Ranieri ..... B26B 5/002 30/162
8,567,070 B2 * 10/2013 Rowlay ..... B26B 5/001 30/162
8,595,941 B2 * 12/2013 Lee ..... B26B 1/08 30/151
8,701,293 B2 * 4/2014 Sullivan ..... B26B 1/08 30/151
8,950,074 B2 * 2/2015 Hsu ..... B26B 5/002 30/162
2013/0081281 A1 * 4/2013 Chu ..... B26B 1/08 30/162
2013/0091712 A1 * 4/2013 Schekalla ..... B26B 1/08 30/162
2013/0239415 A1 * 9/2013 Wagner ..... B26B 5/002 30/162

* cited by examiner

*Primary Examiner* — Ghassem Alie
*Assistant Examiner* — Bharat C Patel
(74) *Attorney, Agent, or Firm* — Shimokaji IP

(57) ABSTRACT

A cutter assembly has a blade holder, a slider, an automatic locking device, a screw locking device and a blade. The blade holder has a guiding channel defined in the blade holder and having two inner edges. Multiple engaging teeth are arranged in a line along at least one of the inner edges. The slider is mounted slidably on the blade holder relative to the guiding channel. The automatic locking device is mounted on the slider and has a resilient member selectively engaging at least one of the engaging teeth. The screw locking device is mounted on the slider and has a relative travel distance between the screw locking device and the slider. The blade is mounted slidably in the blade holder and connected to the slider.

27 Claims, 15 Drawing Sheets

CUTTER ASSEMBLY HAVING DUAL LOCKING EFFECT

BACKGROUND OF THE INVENTION

1. Field of the Invention

The present invention relates to a cutter assembly, and more particularly to a cutter assembly having two locking devices.

2. Description of Related Art

A retractable cutter substantially comprises a blade holder, a blade and a slider. The slider is mounted on the blade holder. The blade is mounted slidably in the blade holder and is connected to the slider. When the slider is pushed, the blade is moved relative to the blade holder to extend out of the blade holder to enable a user to cut an object by the cutter. For use of holding the blade at a desired position with a desired extension length relative to the blade holder, a locking device is mounted on the slider. The conventional locking devices include two different types, an automatic locking device and a screw locking device. The conventional automatic locking device substantially comprises an engaging block and a spring. Multiple engaging teeth are formed on the blade holder, are arranged in a line and selectively engage the engaging block. When the slider is pushed, the engaging block can be disengaged from one of the engaging teeth to enable the blade to move relative to the blade holder. When the blade is moved to a desired position, the engaging block will engage one of the engaging teeth by the force provided by the spring. Thus, the blade can be positioned with a desired extension length relative to the blade holder. Alternatively, the conventional automatic locking device may comprise a single resilient tab.

The conventional screw locking device substantially comprises a bolt mounted on the slider. When the bolt is rotated to make the bolt abut against an inner surface of the blade holder, the slider can be positioned relative to the blade holder. When the bolt is released, the slider is moveable relative to the blade holder to adjust the extension length of the blade relative to the blade holder.

However, although the conventional automatic locking device is convenient in use, the engaging force between the engaging block and the engaging teeth in the blade holder is not sufficient. Therefore, a cutter having the conventional automatic locking device can only be applied to cut a thin object, such as paper, and cannot be applied to cut a thick object. In addition, although a cutter having the conventional screw locking device can provide a sufficient locking force to the blade for cutting a thick object, the screw locking device has to be rotated for unlocking and relocking each time when the extension length of the blade is adjusted. Thus, the conventional screw locking device is not convenient in use.

To overcome the shortcomings, the present invention tends to provide a cutter assembly to mitigate or obviate the aforementioned problems.

SUMMARY OF THE INVENTION

The main objective of the invention is to provide a cutter assembly having two locking devices so that the dual locking effect of an automatic locking and a screw locking is achieved to enhance the convenience for using the cutter assembly.

The cutter assembly in accordance with the present invention has a blade holder, a slider, an automatic locking device, a screw locking device and a blade. The blade holder has a guiding channel defined in the blade holder and having two inner edges. Multiple engaging teeth are arranged in a line along at least one of the inner edges. The slider is mounted slidably on the blade holder relative to the guiding channel and comprises an upper sliding member and a lower sliding member, wherein the lower sliding member has an elongated slot. The automatic locking device is mounted on the lower sliding member of the slider and has a resilient member selectively engaging at least one of the engaging teeth. A pushing recess is disposed in the upper sliding member to push the automatic locking device. The screw locking device is mounted on the slider and has a relative travel distance between the screw locking device and the slider, a locking bolt, a nut, and a clamping member. The locking bolt is mounted rotatably on the upper sliding member and is slidable relative to the lower sliding member to have a relative travel distance between the locking bolt and the lower sliding member, and comprises a head and a threaded rod connected to the head. The threaded rod of the locking bolt slidably extends into the elongated slot of the lower sliding member. The nut is connected to the upper sliding member and screwed with the locking bolt. The clamping member is combined with the upper sliding member, and has a clamping flange formed on a bottom surface of the clamping member and abutting against a bottom surface of the lower sliding member to clamp the lower sliding member. The nut is mounted in the clamping member, and the clamping member and the nut are held slidably in the elongated slot in the lower sliding member. The blade is mounted slidably in the blade holder and connected to the slider With such an arrangement, the cutter assembly has an automatic locking effect and a screw locking effect simultaneously. A user can select different locking effects to hold the blade on a desired position based on different operation purposes. For example, when the cutter assembly is applied to cut paper or a thin object, the automatic effect is selected. To cut a thick object, the screw locking effect is selected. Accordingly, the cutter assembly in accordance with the present invention is convenient and versatile in use.

Other objects, advantages and novel features of the invention will become more apparent from the following detailed description when taken in conjunction with the accompanying drawings.

DETAILED DESCRIPTION OF PREFERRED EMBODIMENT

Figure 1:
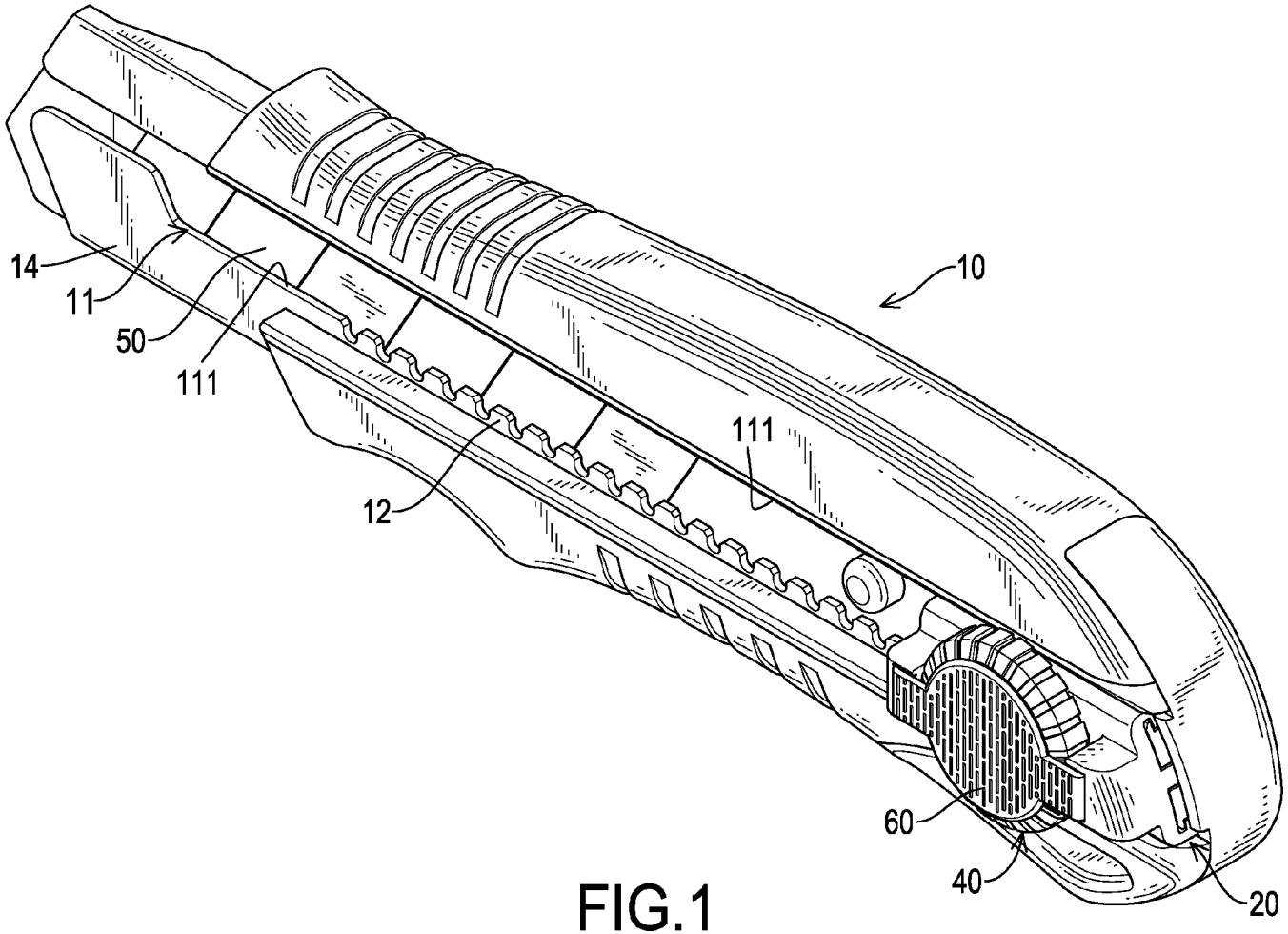
FIG. 1 is a perspective view of a first embodiment of a cutter assembly in accordance with the present invention.
Figure 2:
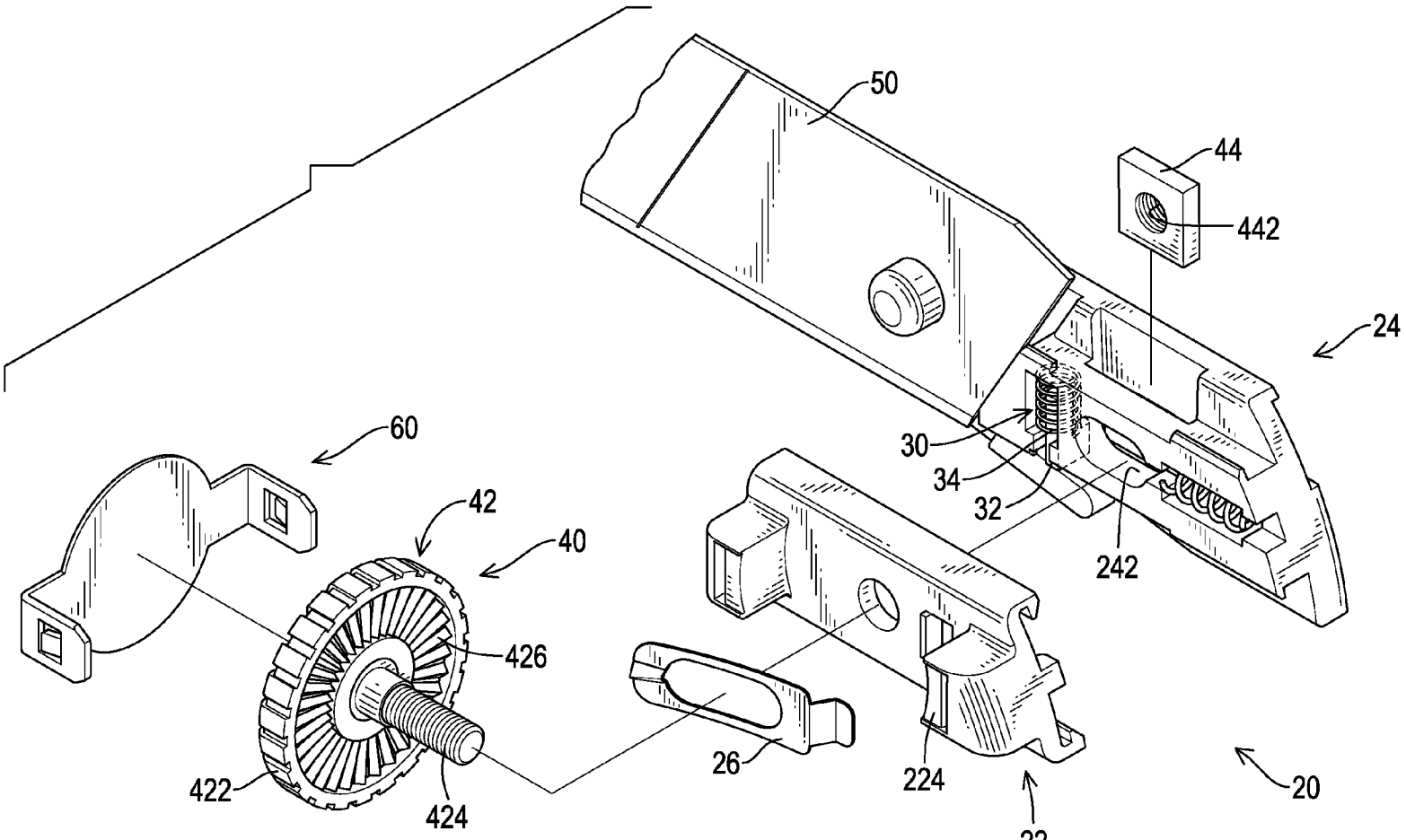
FIG. 2 is an enlarged exploded perspective view of a slider, a blade, a screw locking device and a protective cap of the cutter assembly in FIG. 1.

With reference to FIGS. 1 to 4, a cutter assembly in accordance with the present invention comprises a blade holder 10, a slider 20, an automatic locking device 30, a screw locking device 40 and a blade 50.

The blade holder 10 comprises a guiding channel 11 and a metal base 14. The guiding channel 11 is defined in the blade holder 10 and has two inner edges 111. The metal base 14 has multiple engaging teeth 12 formed on the metal base 14 at a side facing the guiding channel 11 and arranged in a line along at least one of the inner edges 111 of the guiding channel 11.

The slider 20 is mounted slidably on the blade holder 10 relative to the guiding channel 11 and comprises an upper sliding member 22 and a lower sliding member 24.

The automatic locking device 30 is mounted on the slider 20 and has a resilient member selectively engaging at least one of the engaging teeth 12. In the first embodiment, the resilient member comprises an engaging block 32 and a spring 34. The engaging block 32 is retractably mounted on the lower sliding member 24 of the slider 20 and selectively engages one of the engaging teeth 12 on the blade holder 10. The spring 34 abuts against the engaging block 32 to provide the engaging block 32 with a force to engage one of the engaging teeth 12. Alternatively, the resilient member may be a single resilient tab having two bent ends respectively engaging two of the engaging teeth 12. In addition, the upper sliding member 22 has a pushing recess 222 disposed in the upper sliding member 22 and having two ends each provided with an inclined surface to push the engaging block 32 or the bent ends of the resilient tab of the resilient member. The automatic locking device 30 and the pushing recess 222 in the upper sliding member 22 may be conventional, and detailed description thereof is omitted.

The screw locking device 40 is mounted on the slider 20 and has a relative travel distance between the screw locking device 40 and the slider 20. The screw locking device 40 comprises a locking bolt 42 and a locking tab 44 screwed with each other. The locking bolt 42 is mounted rotatably on the upper sliding member 22, is not moveable relative to the upper sliding member 22, and is slidable relative to the lower sliding member 24 to have a relative travel distance between the locking bolt 42 and the lower sliding member 24. The locking bolt 42 comprises a head 422 and a threaded rod 424 connected to the head 422. The threaded rod 424 extends through the slider 20 and selectively abuts against an inner surface of the metal base 14. The lower sliding member 24 has an elongated slot 242 into which the threaded rod 424 of the locking bolt 42 slidably extends. In the first embodiment, the locking tab 44 is mounted in the lower sliding member 24 and has a threaded hole 442 formed in the locking tab 44 and screwed with the threaded rod 424 of the locking bolt 42. Because the locking tab 44 is slidable relative to the lower sliding member 24, the locking bolt 42 can be moved with the upper sliding member 22 relative to the lower sliding member 24.

In addition, a protective cap 60 is mounted on the upper sliding member 22 and covers the head 422 of the locking bolt 42. The protective cap 60 may be U-shaped and has two ends inserted respectively into two combination holes 224 defined in the upper sliding member 22 of the slider 20. With the protective cap 60 mounted across the head 422 of the locking bolt 42, the locking bolt 42 can be prevented from being rotated unintentionally.

Furthermore, the head 422 of the locking bolt 42 further has multiple sounding teeth 426 formed on the head 422 at a side facing the upper sliding member 22 and arranged in a circle. The upper sliding member 22 further has a sounding tab 26 having an end abutting and engaging one of the sounding teeth 426 on the head 422 of the locking bolt 42. When the locking bolt 42 is rotating, sound will be generated by the abutment and engagement between the sounding tab 26 and the sounding teeth 426. In addition, with the engagement between the sounding tab 26 and one of the sounding teeth 426, a positioning effect can be provided to the locking bolt 42 to prevent the locking bolt 42 from being rotated unintentionally.

The blade 50 is mounted slidably in the blade holder 10 and is connected to the lower sliding member 24 of the slider 20, such that the blade 50 can be moved with the slider 20 relative to the blade holder 10.

Figure 3:
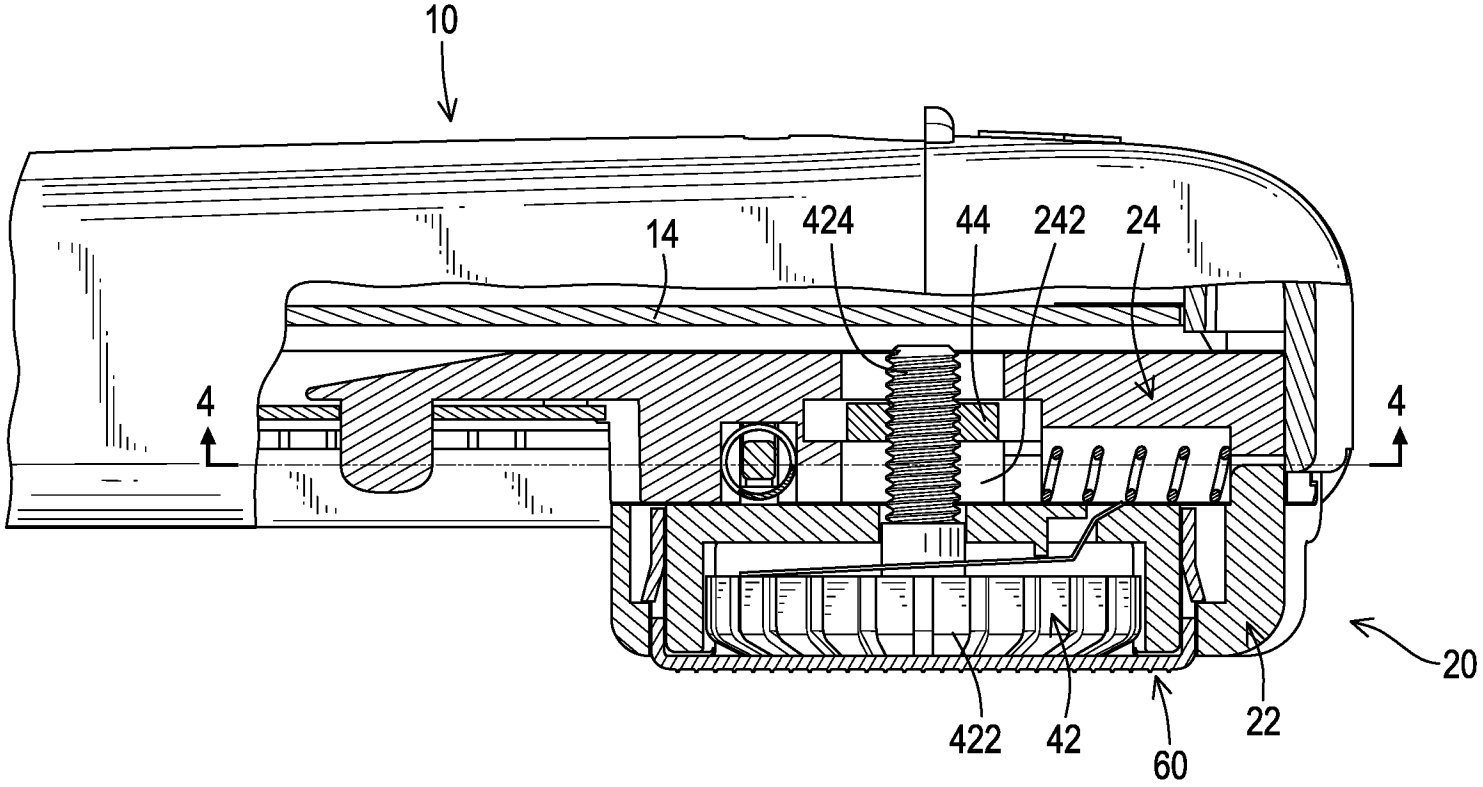
FIG. 3 is an enlarged top view in partial section of the cutter assembly in FIG. 1.
Figure 4:
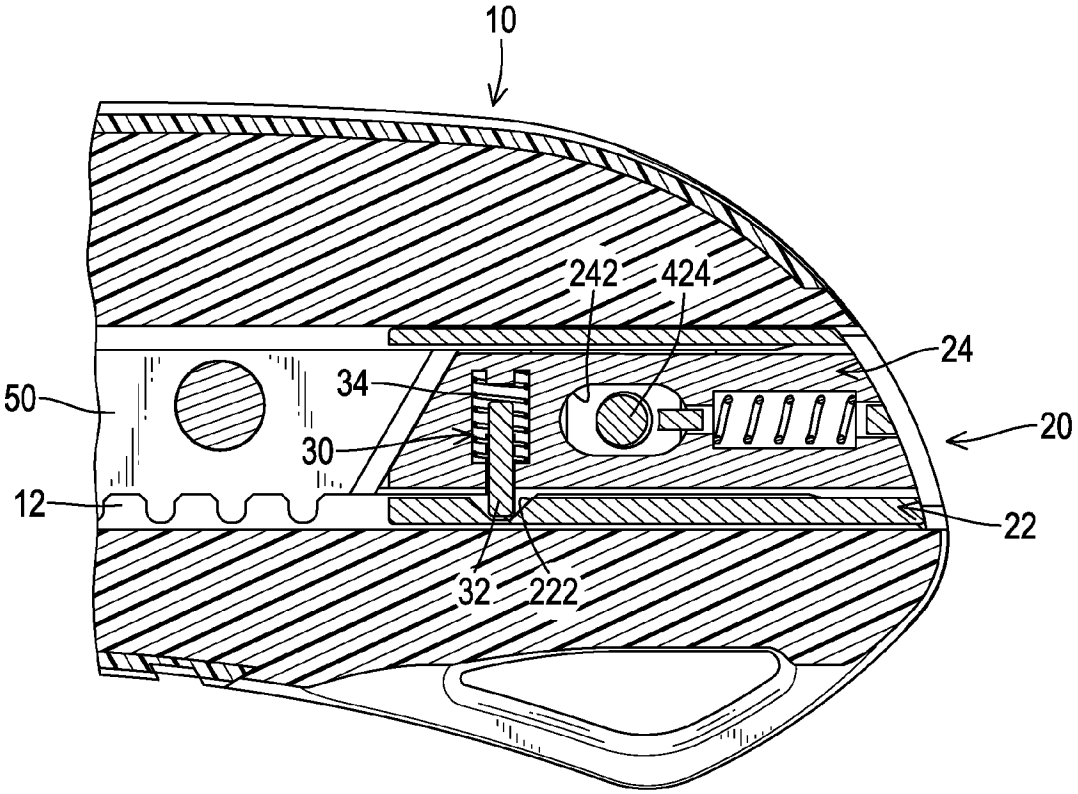
FIG. 4 is a cross sectional side view of the cutter assembly along line 4-4 in FIG. 3.
Figure 5:
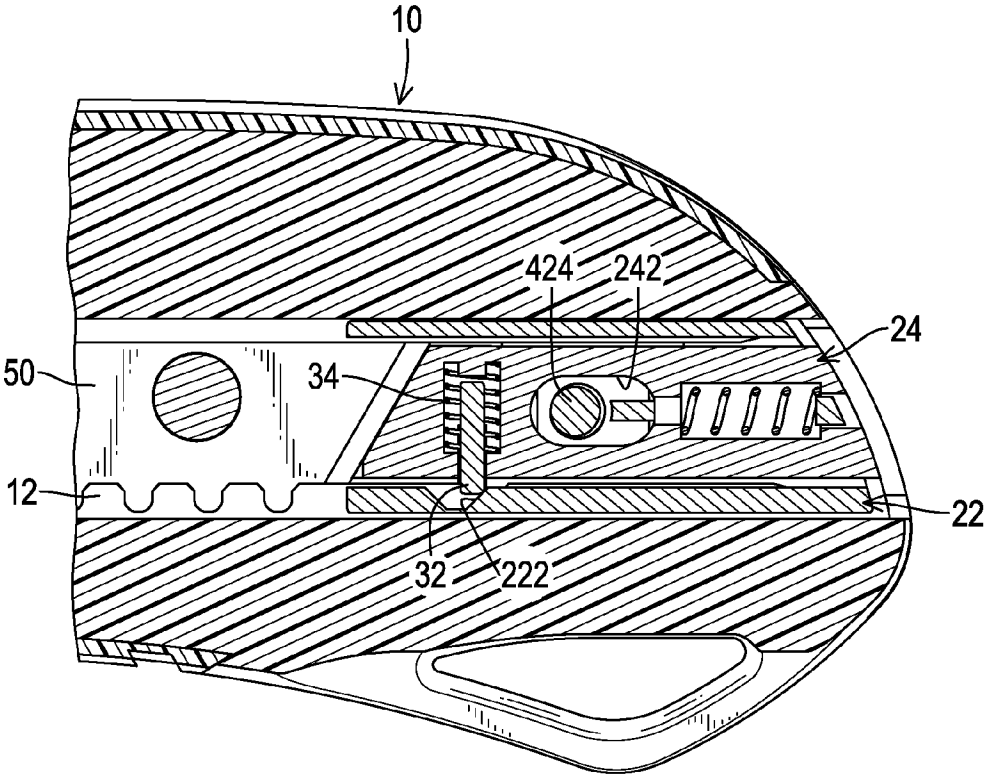
FIG. 5 is an operational cross sectional side view of the cutter assembly in FIG. 4.
Figure 6:
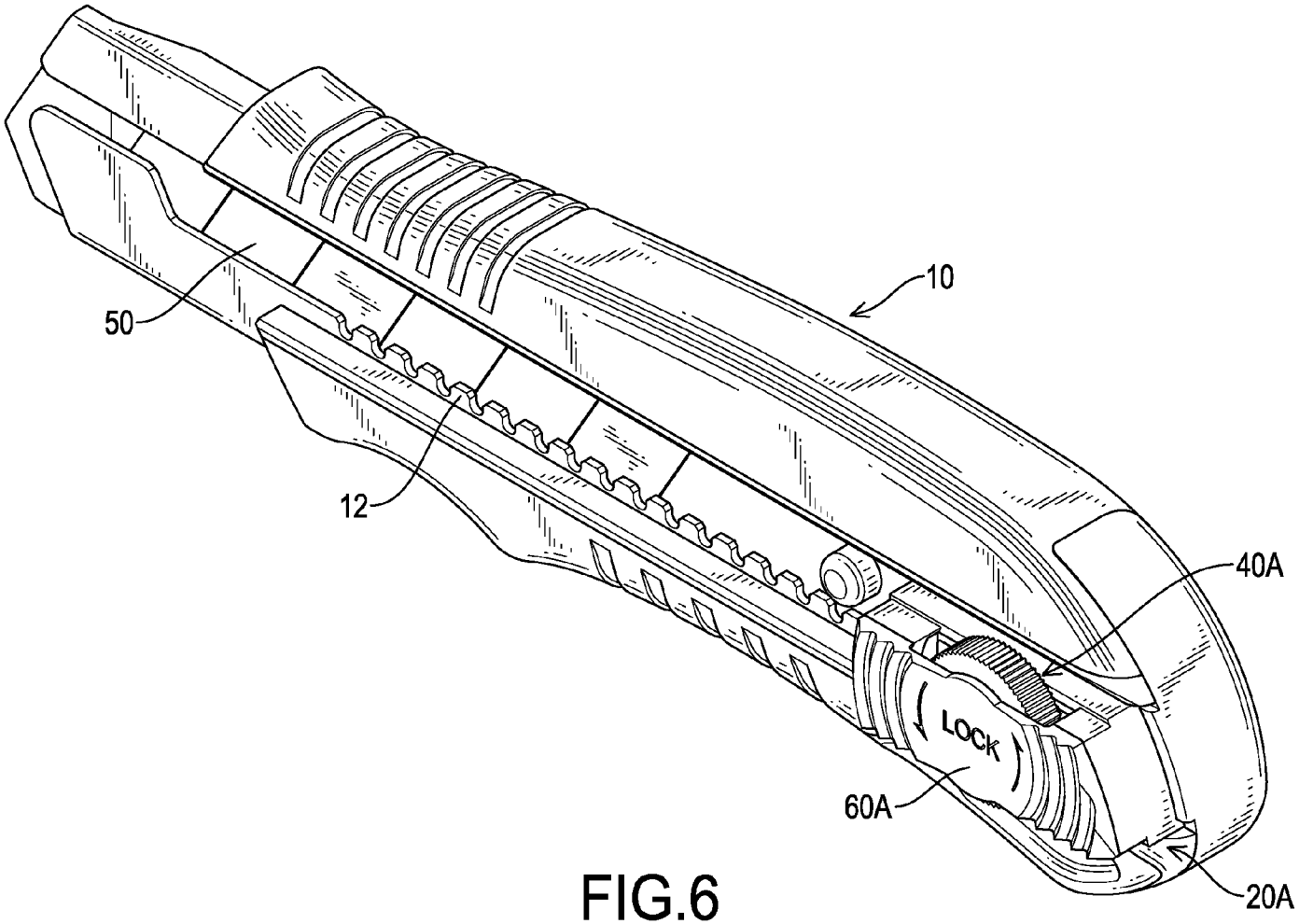
FIG. 6 is a perspective view of a second embodiment of a cutter assembly in accordance with the present invention.
Figure 7:
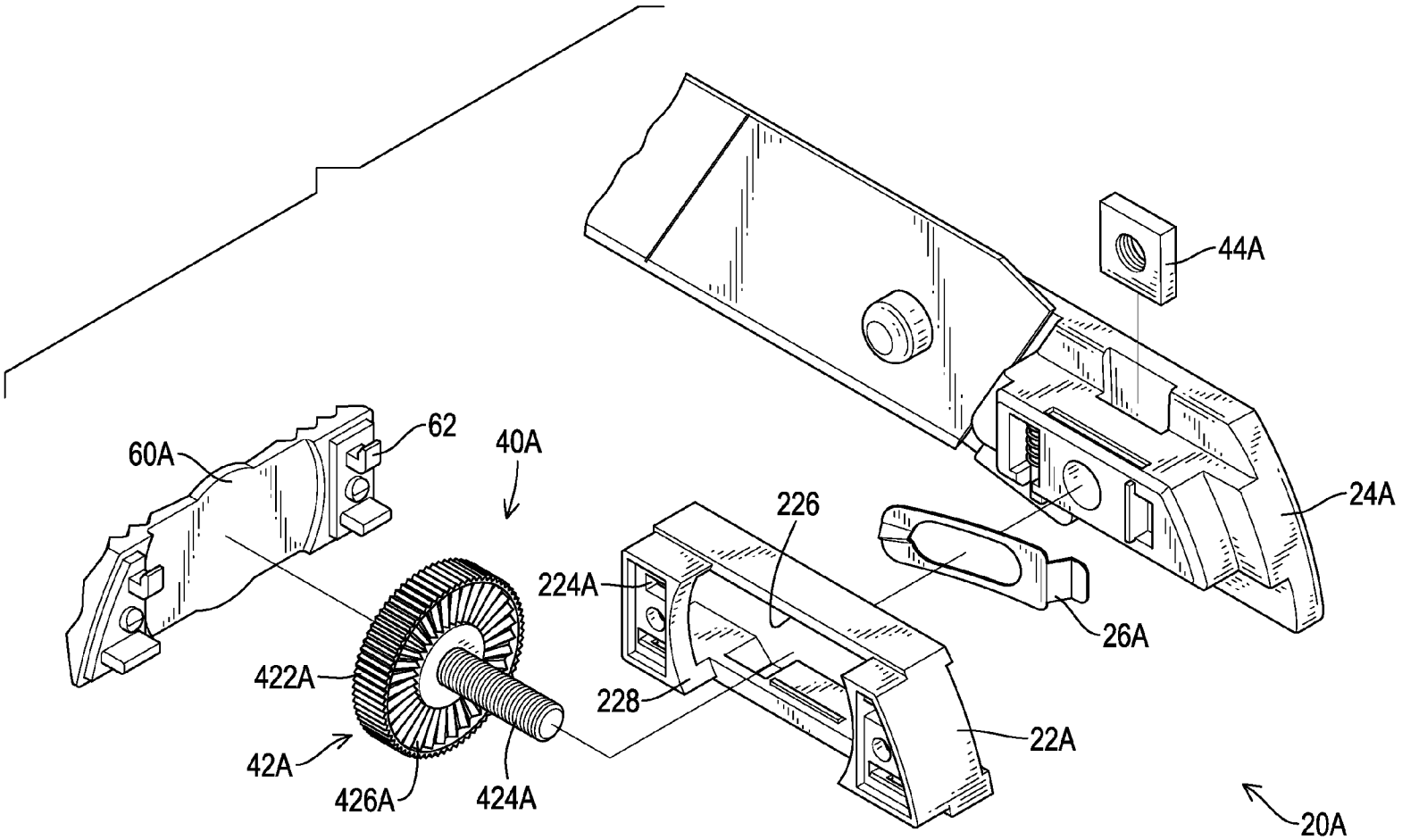
FIG. 7 is an enlarged exploded perspective view of a slider, a blade, a screw locking device and a protective cap of the cutter assembly in FIG. 6.
Figure 8:
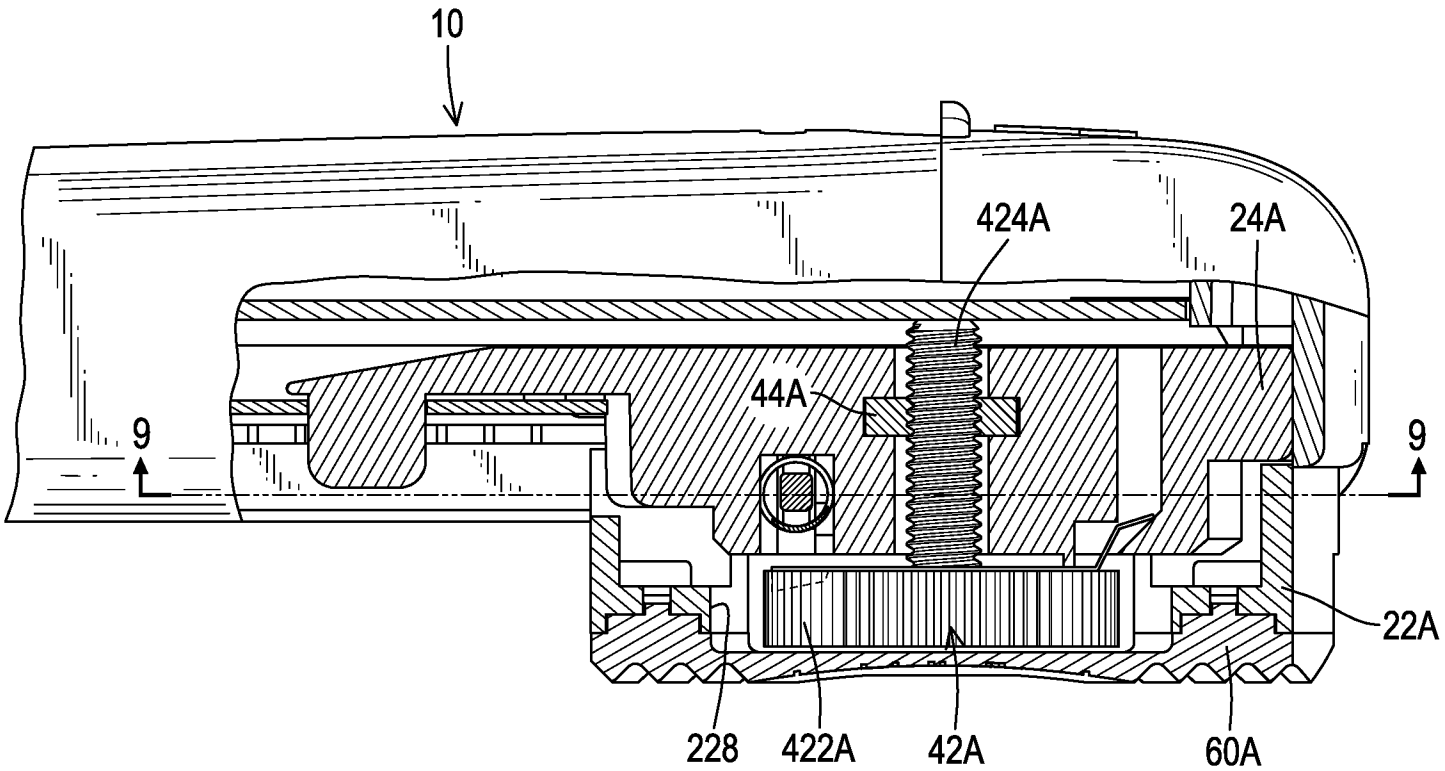
FIG. 8 is an enlarged top view in partial section of the cutter assembly in FIG. 6.

With reference to FIGS. 3 to 5, to cut paper or a thin object, the locking bolt 42 is kept from abutting and is separated from the inner surface of the metal base 14. With the engagement between the automatic locking device 30 and the engaging teeth 12 on the blade holder 10, an automatic locking effect can be provided to the blade 50. When a user pushes the upper sliding member 22, the locking bolt 42 can be moved with the upper sliding member 22 relative to the elongated slot 242 in the lower sliding member 24. Thus, the locking bolt 42 can be moved relative to the lower sliding member 24 to form a relative travel distance therebetween, and the upper sliding member 22 can be pushed to move. At this time, the engaging block 32 or the resilient tab of the automatic locking device 30 can be pressed by the pushing recess 222 in the upper sliding member 22 and disengages from a corresponding engaging tooth 12. Consequently, the slider 20 and the blade 50 can be moved relative to the blade holder 10 so as to adjust the extension length and the position of the blade 50 relative to the blade holder 10. The automatic locking device 30 can provide an automatic locking effect to the blade 50.

To cut a thick object, the locking bolt 42 is rotated to make the threaded rod 424 of the locking bolt 42 abut against the inner surface of the metal base 14. Accordingly, the slider 20 and the blade 50 can be held securely at a desired position relative to the blade holder 10. Thus, a firm locking effect is provided for fitting with a cutting process with a large force.

With the relative travel between the locking bolt 42 and the lower sliding member 24, the upper sliding member 22 can be prevented from being jammed by the locking bolt 42 when the upper sliding member 22 is pushed to move. With such an arrangement, the automatic locking device 30 and the screw locking device 40 can be simultaneously mounted on the slider 20 to provide a dual locking effect.

With reference to FIGS. 6 to 10, a second embodiment of a cutter assembly in accordance with the present invention, the structural arrangement of the second embodiment is similar to that of the first embodiment except that the screw locking device 40A has a relative travel distance relative to the upper sliding member 22A and is not slidable relative to the lower sliding member 24A. The upper sliding member 22A has an elongated slot 226 into which the threaded rod 424A of the locking bolt 42A slidably extends. The upper sliding member 22A further has a sliding space 228 formed in the upper sliding member 22A and adjacent to the elongated slot 226. The sliding space 228 has a length larger than a diameter of the head 422A of the locking bolt 42A. The head 422A of the locking bolt 42A is held slidably in the sliding space 228. The locking tab 44A is mounted securely in the lower sliding member 24A. With such an arrangement, the locking bolt 42A is combined with the locking tab 44A which is securely mounted in the lower sliding member 24A, and thus the locking bolt 42A is not moved with the upper sliding member 22A and the protective cap 60A when the upper sliding member 22A is pushed to move. In addition, the sounding tab 26A is mounted on the lower sliding member 24A and extends through the elongated slot 226 and the sliding space 228 to engage one of the sounding teeth 426A on the locking bolt 42A. Furthermore, the protective cap 60A may be a tab and has two ends and two hooks 62 formed respectively on the ends of the protective cap 60A at a face facing the upper sliding member 22A, and the hooks 62 engage respectively two combination holes 224A formed in the upper sliding member 22A.

Figure 9:
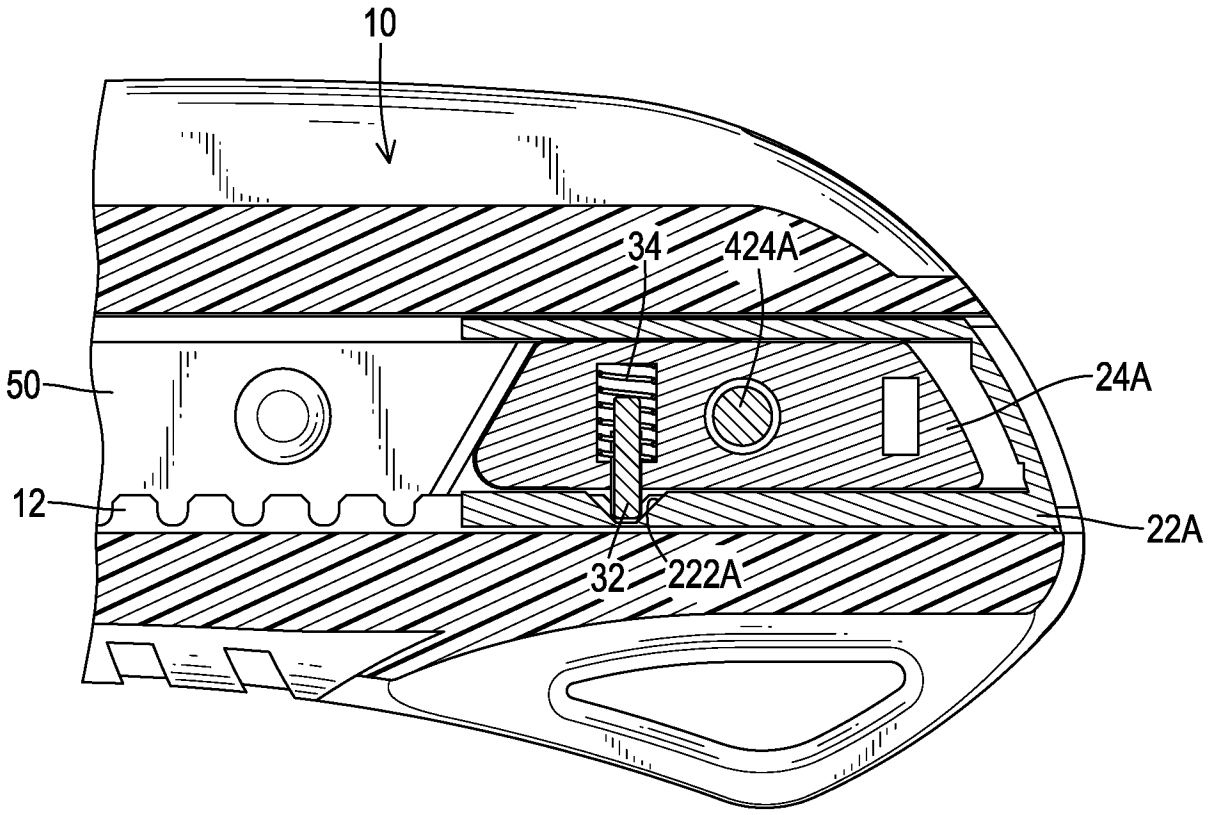
FIG. 9 is a cross sectional side view of the cutter assembly along line 9-9 in FIG. 8.
Figure 10:
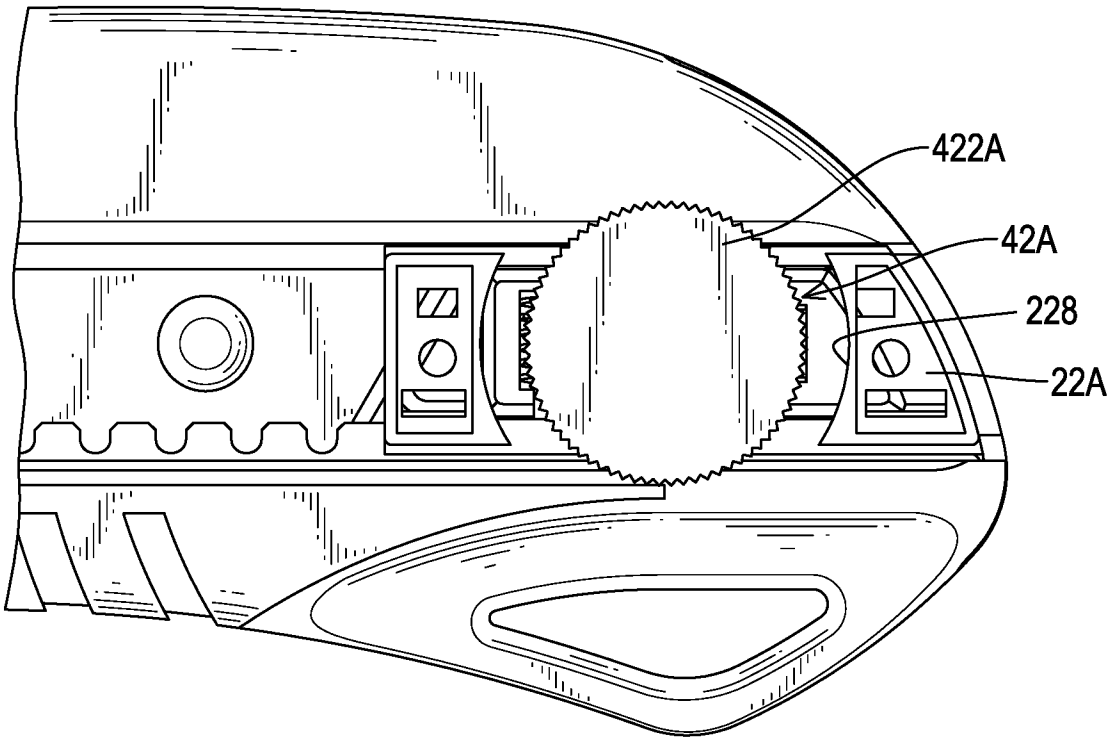
FIG. 10 is an enlarged side view of the cutter assembly in FIG. 6 with the protective cap removed.
Figure 11:
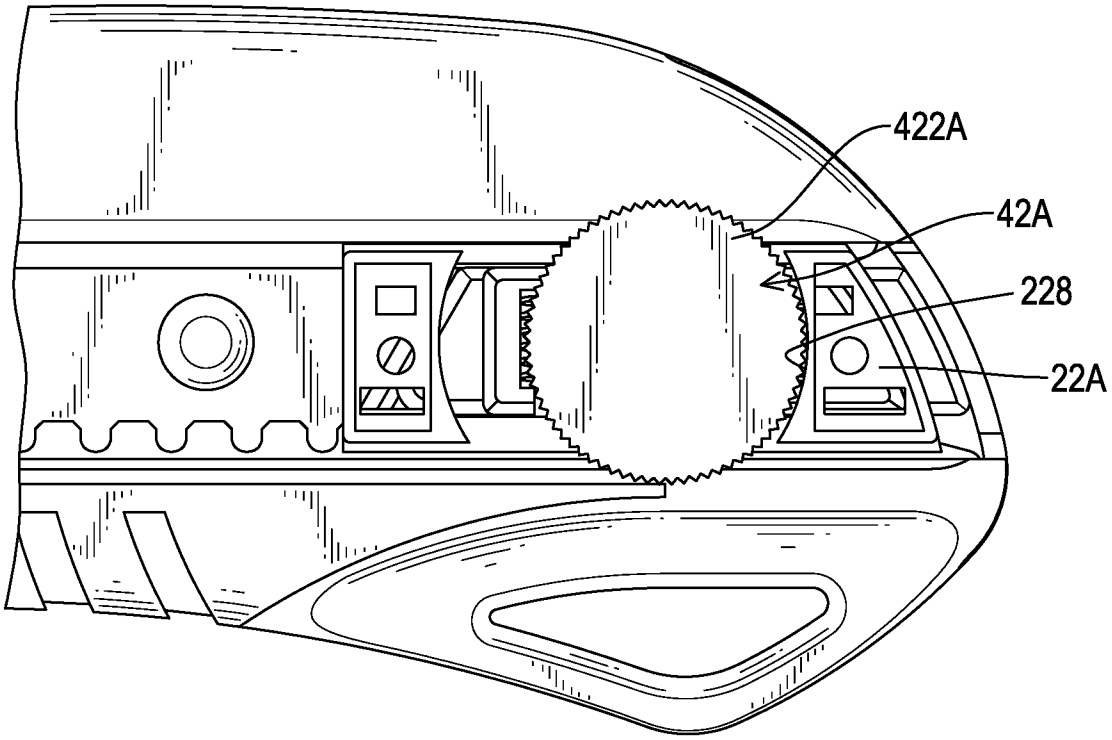
FIG. 11 is an operational side view of the cutter assembly in FIG. 10.

When the upper sliding member 22A is pushed, with reference to FIGS. 9 and 11, the locking bolt 42A has a relative travel distance relative to the upper sliding member 22A because the length of the sliding space 228 is larger than the diameter of the head 422A of the locking bolt 42A and the head 422A of the locking bolt 42A is slidable relative to the elongated slot 226. Thus, the locking bolt 42A is kept from being moved with the upper sliding member 22A temporarily. When the upper sliding member 22A is moved to a position where the engaging block 32 or the resilient tab of the automatic locking device 30 is pushed by the pushing recess 222A in the upper sliding member 22A and disengages from a corresponding engaging tooth 12 on the blade holder 10, the upper sliding member 22A will abut against the head 422A of the locking bolt 42A. Consequently, the locking bolt 42A and the lower sliding member 24A will be moved with the upper sliding member 22A, and the extension length and the position of the blade 50 relative to the bladed holder 10 are adjusted. With the relative travel between the upper sliding member 22A and the locking bolt 42A, the upper sliding member 22A can be prevented from being jammed by the locking bolt 42A when the upper sliding member 22A is pushed to move.

Figure 12:
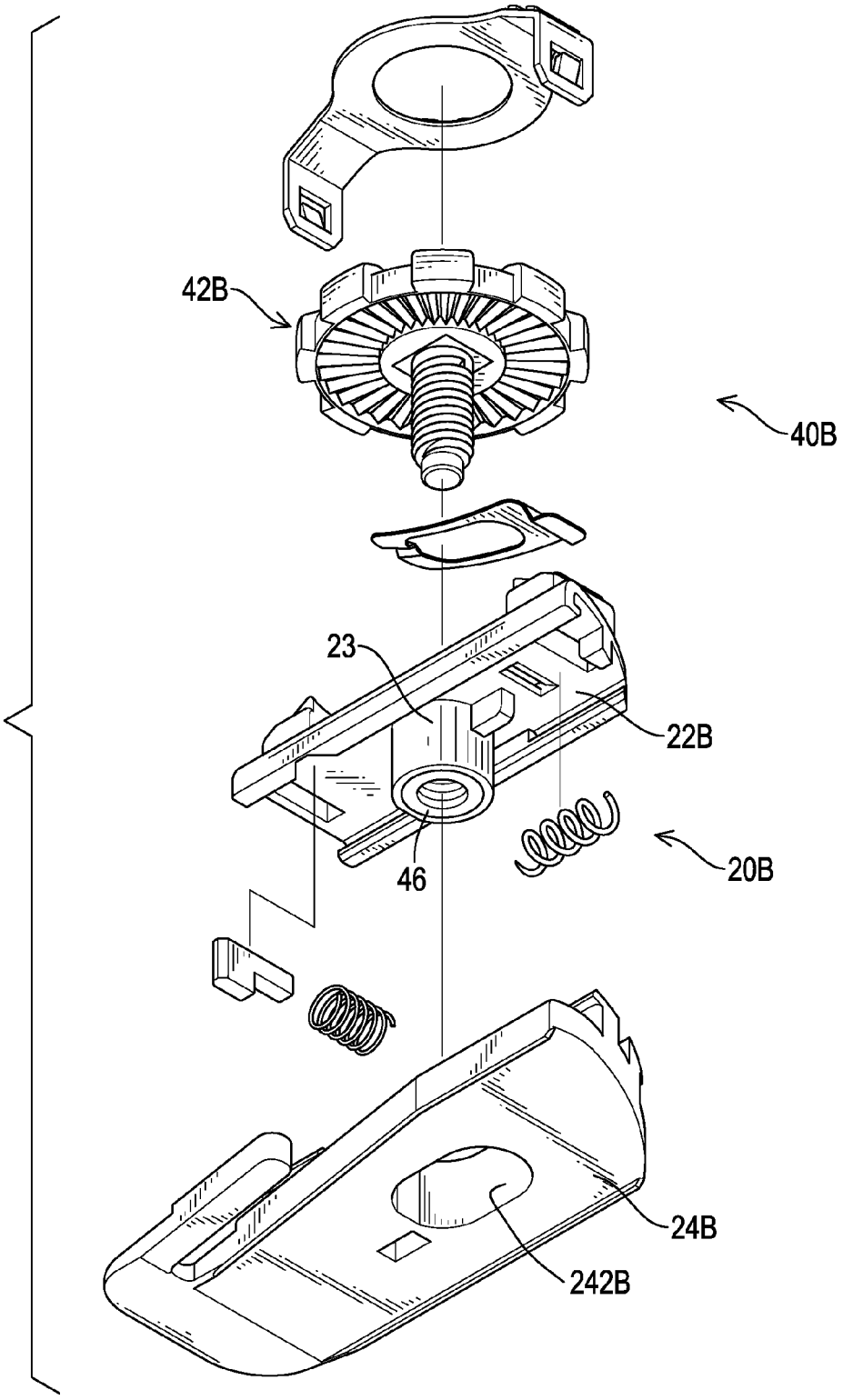
FIG. 12 is an exploded perspective view of a third embodiment of a slider, a screw locking device and a protective cap of a cutter assembly in accordance with the present invention.
Figure 13:
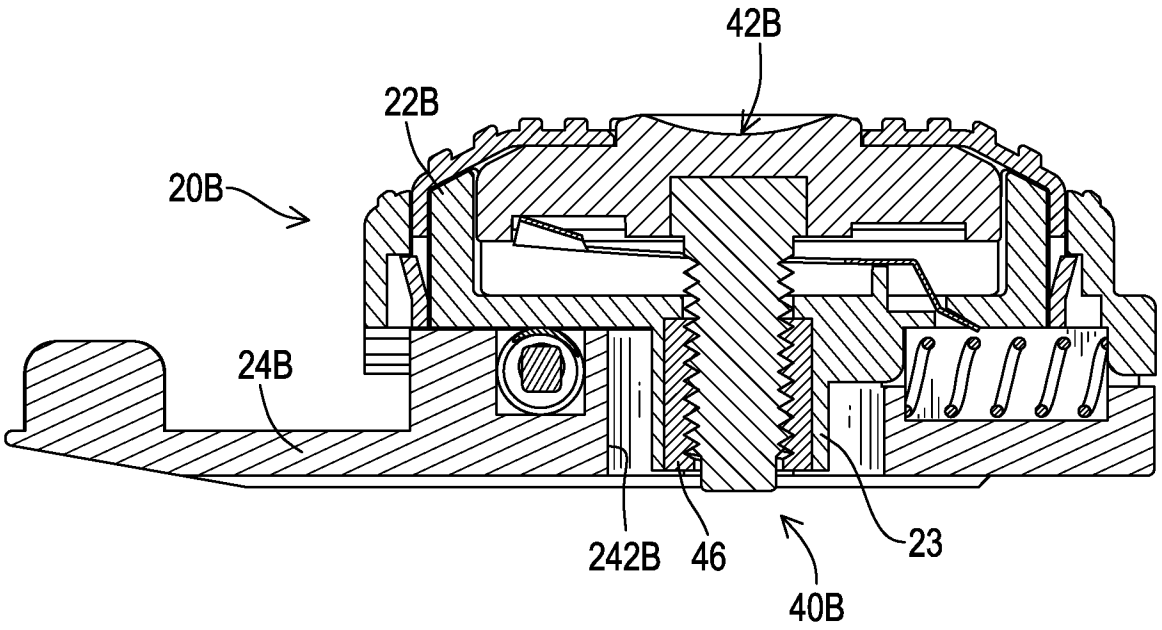
FIG. 13 is a cross sectional side view of the cutter assembly in FIG. 12.

With reference to FIGS. 12 and 13, a third embodiment of a cutter assembly in accordance with the present invention, the structure of the third embodiment is similar to that of the first embodiment, but the structure of the slider 20B is slightly different with that of the first embodiment. The screw locking device 40B has a relative travel distance relative to the lower sliding member 24B and comprises a nut 46 mounted securely in the upper sliding member 22B and screwed with the locking bolt 42B. The upper sliding member 22B further has a receiving tube 23 formed on and protruding from a bottom surface of the upper sliding member 22B and holding the nut 46 inside the receiving tube 23. The receiving tube 23 and the nut 46 are held slidably in the elongated slot 242B in the lower sliding member 24B. The operation of the third embodiment is similar to that of the first embodiment and detailed description is omitted.

Figure 14:
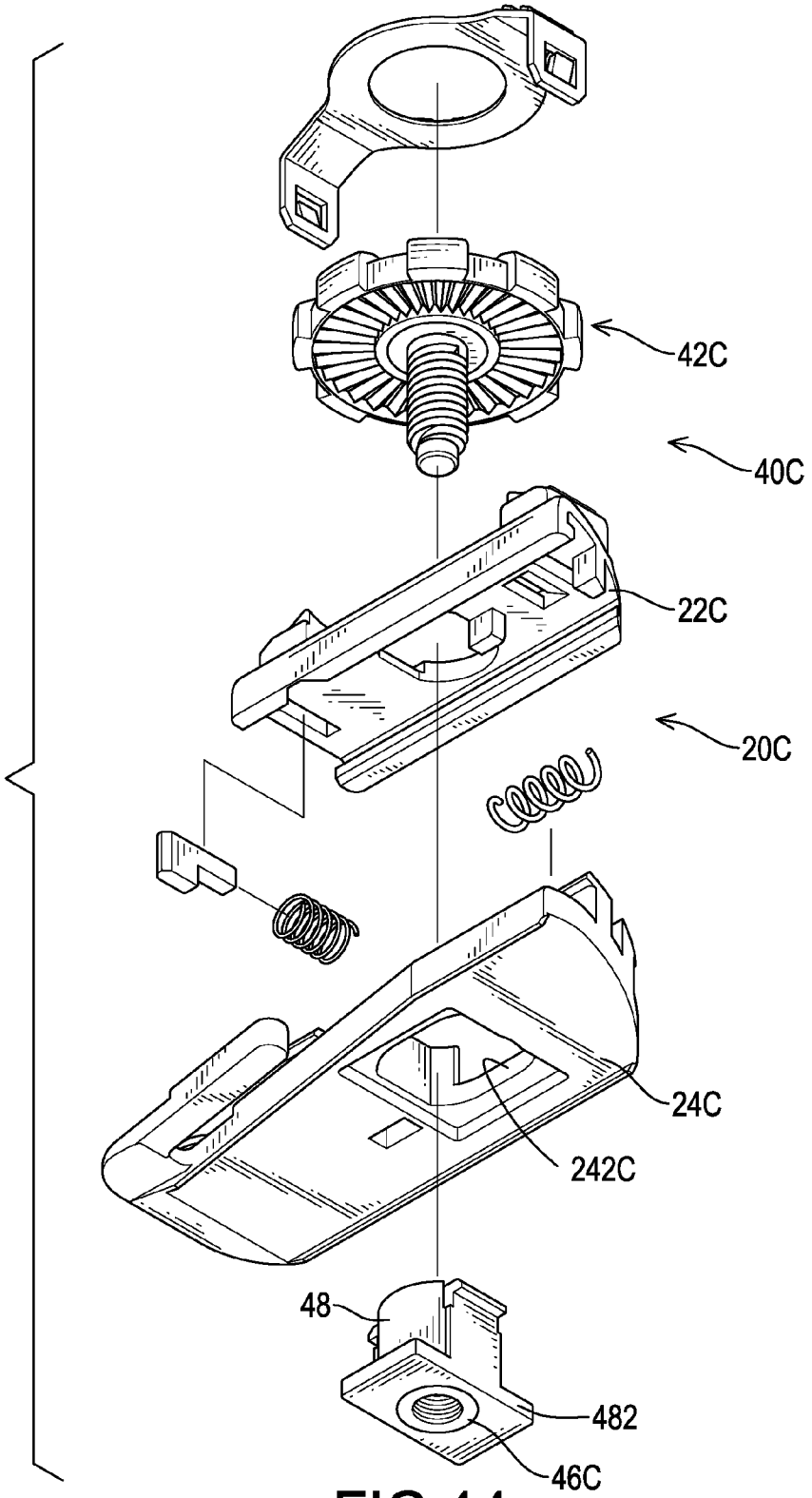
FIG. 14 is an exploded perspective view of a fourth embodiment of a slider, a screw locking device and a protective cap of a cutter assembly in accordance with the present invention.
Figure 15:
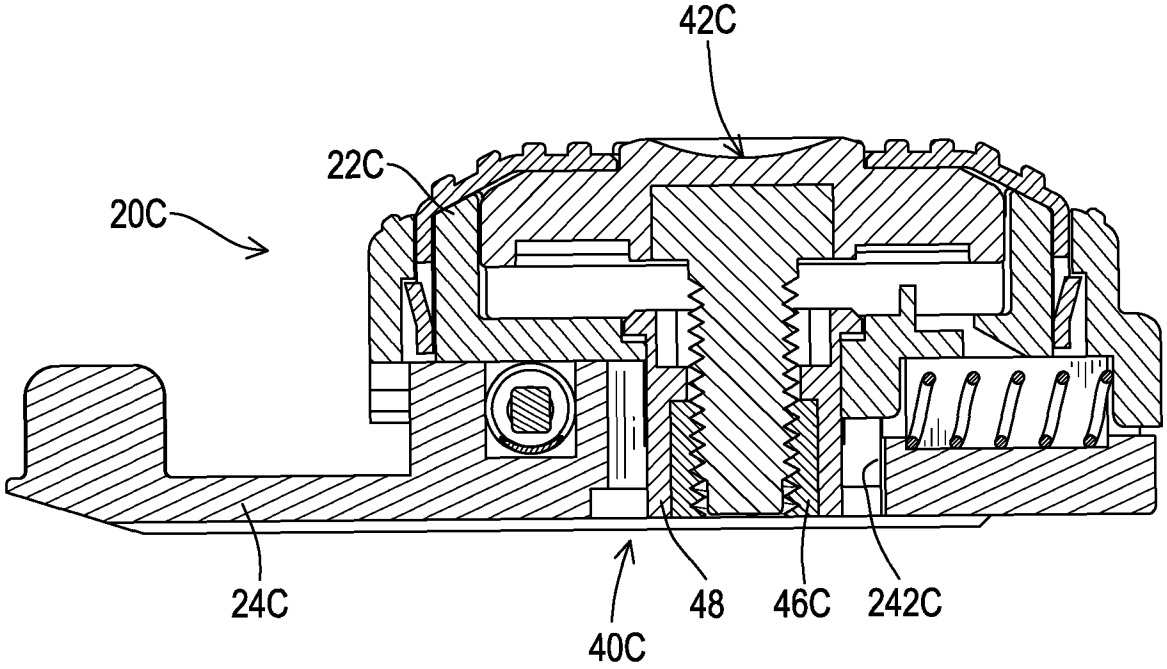
FIG. 15 is a cross sectional side view of the cutter assembly in FIG. 14.

With reference to FIGS. 14 and 15, a fourth embodiment of a cutter assembly in accordance with the present invention, the structure of the fourth embodiment is similar to that of the third embodiment. The screw locking device 40C has a relative travel distance relative to the lower sliding member 24C. The nut 46C of the screw locking device 40C is mounted in a clamping member 48 and is screwed with the locking bolt 42C. With the clamping member 48, the nut 46C is connected with the upper sliding member 22C. The clamping member 48 is combined with the upper sliding member 22C to clamp the lower sliding member 24C. The clamping member 48 has a clamping flange 482 formed on a bottom surface of the clamping member 48 and abutting against a bottom surface of the lower sliding member 24C to clamp the lower sliding member 24C. The clamping member 48 and the nut 46C are held slidably in the elongated slot 242C of the lower sliding member 24C. With the connection between the clamping member 48 and the upper sliding member 22C to clamp the lower sliding member 24C, the structural strength of the slider 20C can be enhanced to prevent the upper and lower sliding members 22C, 24C from being detached from each other unintentionally when the locking bolt 42C abuts against the metal base 14 with a huge force. The stability of the structure of the slider 20C is improved. The operation of the fourth embodiment is similar to that of the third embodiment and detailed description is omitted.

With the relative travel between the screw locking device 40, 40A, 40B, 40C and the slider 20, 20A, 20B, 20C, the slider 20, 20A, 20B, 20C can be prevented from being jammed by the locking bolt 42, 42A, 42B, 42C when the slider 20, 20A, 20B, 20C is pushed to move. Dual locking effect of automatic locking and screw locking is achieved, such that the cutter assembly in accordance with the present invention can be applied for different operation needs. With the locking effect provided by the automatic locking device 30 or the screw locking device 40, 40A, 40B, 40C, the blade 50 can be held in position relative to the bladed holder 10, and the user can select different locking effects based on different operation purposes so the cutter assembly in accordance with the present invention is versatile and convenient in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cutter assembly comprising:

a blade holder having a guiding channel defined in the blade holder and having two inner edges, wherein multiple engaging teeth are arranged in a line along at least one of the inner edges;

a slider mounted slidably on the blade holder relative to the guiding channel and comprising an upper sliding member and a lower sliding member, wherein the lower sliding member has an elongated slot;

an automatic locking device mounted on the lower sliding member of the slider and having a resilient member selectively engaging at least one of the engaging teeth;

a pushing recess disposed in the upper sliding member to push the automatic locking device;

a screw locking device mounted on the slider and having a relative travel distance between the screw locking device and the slider;

a locking bolt mounted rotatably on the upper sliding member and being slidable relative to the lower sliding member to have a relative travel distance between the locking bolt and the lower sliding member, and comprising a head and a threaded rod connected to the head, wherein the threaded rod of the locking bolt slidably extends into the elongated slot of the lower sliding member;

a nut connected to the upper sliding member and screwed with the locking bolt; and a clamping member combined with the upper sliding member, and having a clamping flange formed on a bottom surface of the clamping member and abutting against a bottom surface of the lower sliding member to clamp the lower sliding member, wherein the nut is mounted in the clamping member, and the clamping member and the nut are held slidably in the elongated slot in the lower sliding member; and a blade mounted slidably in the blade holder and connected to the slider.

2. The cutter assembly as claimed in claim 1, wherein the screw locking device comprises a locking bolt mounted rotatably on the upper sliding member and being slidable relative to the lower sliding member to have a relative travel distance between the locking bolt and the lower sliding member; and a locking tab screwed with the locking bolt.

3. The cutter assembly as claimed in claim 2, wherein the locking bolt comprises a head and a threaded rod connected to the head;

the lower sliding member has an elongated slot into which the threaded rod of the locking bolt slidably extends; and the locking tab is mounted in the lower sliding member and has a threaded hole formed in the locking tab and screwed with the threaded rod of the locking bolt.

4. The cutter assembly as claimed in claim 3, wherein the head of the locking bolt has multiple sounding teeth formed on the head at a side facing the upper sliding member and arranged in a circle;

the upper sliding member further has a sounding tab having an end abutting and engaging one of the sounding teeth on the head of the locking bolt.

5. The cutter assembly as claimed in claim 4 further comprising a protective cap mounted on the slider to cover the screw locking device.

6. The cutter assembly as claimed in claim 5, wherein the slider has two combination holes defined in the slider; and the protective cap is U-shaped and has two ends inserted respectively into the combination holes in the slider.

7. The cutter assembly as claimed in claim 5, wherein the slider has two combination holes defined in the slider; and the protective cap is a tab and has two ends and two hooks formed respectively on the ends of the protective cap at a face facing the slider, and the hooks engage respectively the combination holes in the slider.

8. The cutter assembly as claimed in claim 1, wherein the screw locking device comprises a locking bolt mounted rotatably on the upper sliding member and being slidable relative to the lower sliding member to have a relative travel distance between the locking bolt and the lower sliding member; and a nut mounted securely in the upper sliding member and screwed with the locking bolt.

9. The cutter assembly as claimed in claim 8, wherein the upper sliding member further has a receiving tube formed on and protruding from a bottom surface of the upper sliding member and holding the nut inside the receiving tube.

10. The cutter assembly as claimed in claim 9, wherein the locking bolt comprises a head and a threaded rod connected to the head;

the lower sliding member has an elongated slot into which the threaded rod of the locking bolt slidably extends; and the receiving tube and the nut are held slidably in the elongated slot in the lower sliding member.

11. The cutter assembly as claimed in claim 10, wherein the head of the locking bolt has multiple sounding teeth formed on the head at a side facing the upper sliding member and arranged in a circle;

the upper sliding member further has a sounding tab having an end abutting and engaging one of the sounding teeth on the head of the locking bolt.

12. The cutter assembly as claimed in claim 11 further comprising a protective cap mounted on the slider to cover the screw locking device.

13. The cutter assembly as claimed in claim 12, wherein the slider has two combination holes defined in the slider; and the protective cap is U-shaped and has two ends inserted respectively into the combination holes in the slider.

14. The cutter assembly as claimed in claim 12, wherein the slider has two combination holes defined in the slider; and the protective cap is a tab and has two ends and two hooks formed respectively on the ends of the protective cap at a face facing the slider, and the hooks engage respectively the combination holes in the slider.

15. The cutter assembly as claimed in claim 1, wherein the head of the locking bolt has multiple sounding teeth formed on the head at a side facing the upper sliding member and arranged in a circle;

the upper sliding member further has a sounding tab having an end abutting and engaging one of the sounding teeth on the head of the locking bolt.

16. The cutter assembly as claimed in claim 15 further comprising a protective cap mounted on the slider to cover the screw locking device.

17. The cutter assembly as claimed in claim 16, wherein the slider has two combination holes defined in the slider; and the protective cap is U-shaped and has two ends inserted respectively into the combination holes in the slider.

18. The cutter assembly as claimed in claim 16, wherein the slider has two combination holes defined in the slider; and the protective cap is a tab and has two ends and two hooks formed respectively on the ends of the protective cap at a face facing the slider, and the hooks engage respectively the combination holes in the slider.

19. The cutter assembly as claimed in claim 1, wherein the screw locking device comprises a locking bolt mounted rotatably on the upper sliding member and being slidable relative to the upper sliding member to have a relative travel distance between the locking bolt and the upper sliding member; and a locking tab screwed with the locking bolt.

20. The cutter assembly as claimed in claim 19, wherein the locking bolt comprises a head and a threaded rod connected to the head;

the upper sliding member has an elongated slot into which the threaded rod of the locking bolt slidably extends; and a sliding space formed in the upper sliding member and having a length larger than a diameter of the head of the locking blot;

the head of the locking bolt is held slidably in the sliding space;

the locking tab is mounted in the lower sliding member and has a threaded hole formed in the locking tab and screwed with the threaded rod of the locking bolt.

21. The cutter assembly as claimed in claim 20, wherein the head of the locking bolt has multiple sounding teeth formed on the head at a side facing the upper sliding member and arranged in a circle;

the lower sliding member further has a sounding tab having an end extending through the elongated slot and the sliding space and abutting and engaging one of the sounding teeth on the head of the locking bolt.

22. The cutter assembly as claimed in claim 21 further comprising a protective cap mounted on the slider to cover the screw locking device.

23. The cutter assembly as claimed in claim 22, wherein the slider has two combination holes defined in the slider; and the protective cap is U-shaped and has two ends inserted respectively into the combination holes in the slider.

24. The cutter assembly as claimed in claim 22, wherein the slider has two combination holes defined in the slider; and the protective cap is a tab and has two ends and two hooks formed respectively on the ends of the protective cap at a face facing the slider, and the hooks engage respectively the combination holes in the slider.

25. The cutter assembly as claimed in claim 1 further comprising a protective cap mounted on the slider to cover the screw locking device.

26. The cutter assembly as claimed in claim 25, wherein the slider has two combination holes defined in the slider; and the protective cap is U-shaped and has two ends inserted respectively into the combination holes in the slider.

27. The cutter assembly as claimed in claim 25, wherein the slider has two combination holes defined in the slider; and the protective cap is a tab and has two ends and two hooks formed respectively on the ends of the protective cap at a face facing the slider, and the hooks engage respectively the combination holes in the slider.

* * * * *